US008316946B2

(12) United States Patent
June et al.

(10) Patent No.: US 8,316,946 B2
(45) Date of Patent: Nov. 27, 2012

(54) SUBSEA COMPLETION WITH A WELLHEAD ANNULUS ACCESS ADAPTER

(75) Inventors: David R. June, Houston, TX (US); Scott D. Ward, Houston, TX (US); David R. Gwyn, Houston, TX (US)

(73) Assignee: Cameron International Corporation, Houston, TX (US)

( * ) Notice: Subject to any disclaimer, the term of this patent is extended or adjusted under 35 U.S.C. 154(b) by 423 days.

(21) Appl. No.: 12/607,736

(22) Filed: Oct. 28, 2009

(65) Prior Publication Data

US 2010/0101800 A1 Apr. 29, 2010

Related U.S. Application Data

(60) Provisional application No. 61/109,063, filed on Oct. 28, 2008.

(51) Int. Cl.
*E21B 34/04* (2006.01)

(52) U.S. Cl. ..... 166/344; 166/368; 166/373; 166/319

(58) Field of Classification Search ..... 166/344, 166/338, 339, 341, 351, 368, 373–375, 86.1, 166/87.1, 316, 319
See application file for complete search history.

(56) References Cited

U.S. PATENT DOCUMENTS 4,116,044 A * 9/1978 Garrett ..... 73/40.5 R
4,449,583 A * 5/1984 Lawson ..... 166/72
4,903,774 A * 2/1990 Dykes et al. ..... 166/363
5,143,158 A * 9/1992 Watkins et al. ..... 166/344
5,366,017 A * 11/1994 Voss, Jr. ..... 166/368
5,544,707 A * 8/1996 Hopper et al. ..... 166/382
6,039,119 A * 3/2000 Hopper et al. ..... 166/368
6,082,460 A * 7/2000 June ..... 166/348
6,186,239 B1 * 2/2001 Monjure et al. ..... 166/384
6,360,822 B1 * 3/2002 Robertson ..... 166/368
6,378,613 B1 * 4/2002 Kent et al. ..... 166/368
6,408,947 B1 * 6/2002 Cunningham et al. ..... 166/339
6,513,596 B2 * 2/2003 Wester ..... 166/336
6,547,008 B1 * 4/2003 Hopper et al. ..... 166/348
6,655,455 B2 * 12/2003 Bartlett et al. ..... 166/86.2
6,705,401 B2 * 3/2004 Buckle et al. ..... 166/337
6,729,392 B2 * 5/2004 DeBerry et al. ..... 166/75.14
6,763,891 B2 * 7/2004 Humphrey et al. ..... 166/368
6,991,039 B2 * 1/2006 Hopper et al. ..... 166/348
7,044,227 B2 * 5/2006 Jennings et al. ..... 166/345
7,073,591 B2 * 7/2006 Massie et al. ..... 166/348
7,093,660 B2 * 8/2006 Hopper et al. ..... 166/348
7,117,945 B2 * 10/2006 Hopper et al. ..... 166/348
7,191,830 B2 * 3/2007 McVay et al. ..... 166/242.1

(Continued)

OTHER PUBLICATIONS

PCT/US2009/062373 International Search Report and Written Opinion, May 17, 2010.

*Primary Examiner* — Matthew Buck
(74) *Attorney, Agent, or Firm* — Chamberlain Hrdlicka

(57) ABSTRACT

A subsea completion assembly for a subsea well including installed casing and a wellhead. The assembly includes a production casing forming a B annulus between the outside of the production casing and the installed casing. The assembly also includes an annulus access adapter installed in the wellhead, the adapter including a manipulatable valve controlling fluid communication with the fluid in the B annulus across the annulus access adapter. A property of the fluid in the B annulus can be monitored by fluid communicated across the annulus access adapter.

24 Claims, 8 Drawing Sheets

FIG. 2

U.S. PATENT DOCUMENTS 7,308,943 B2 * 12/2007 Hopper et al. ..... 166/348
7,314,085 B2 * 1/2008 Hopper et al. ..... 166/348
7,314,086 B2 1/2008 Hopper
7,419,001 B2 * 9/2008 Broussard ..... 166/77.51
7,500,524 B2 * 3/2009 Hopper et al. ..... 166/348
7,604,047 B2 * 10/2009 Broussard ..... 166/75.14
2002/0117305 A1 * 8/2002 Calder et al. ..... 166/358
2003/0121667 A1 * 7/2003 Massie et al. ..... 166/344

* cited by examiner

SUBSEA COMPLETION WITH A WELLHEAD ANNULUS ACCESS ADAPTER

CROSS-REFERENCE TO RELATED APPLICATIONS

This application claims the benefit of U.S. Provisional Application No. 61/109,063, filed 28 Oct. 2008, and entitled "Subsea Completion with a Wellhead Annulus Access Adapter," hereby incorporated herein by reference.

STATEMENT REGARDING FEDERALLY SPONSORED RESEARCH OR DEVELOPMENT

Not Applicable.

BACKGROUND

Conventionally, wells in oil and gas fields are built up by establishing a wellhead housing and, with a drilling blow out preventer (BOP) stack installed, drilling down to produce the borehole while successively installing concentric casing strings. The casing strings are cemented at their lower ends and sealed with mechanical seal assemblies at their upper ends. In order to convert the cased well for production, a production tubing string is run in through the BOP stack and a tubing hanger at its upper end is typically landed in the wellhead. Thereafter the drilling BOP stack is removed and replaced by a Christmas tree having one or more production bores containing valves and extending vertically to respective lateral production fluid outlet ports in the wall of the tree.

Alternatively, a well may include a horizontal style Christmas tree fixed and sealed to the wellhead housing, and including at least a lateral production fluid outlet port connected to an actuated valve. With a horizontal tree, the tubing hanger is landed in the spool tree with a lateral production fluid outlet port in the tubing hanger aligned with a corresponding lateral production port in the spool tree. With this arrangement, the spool tree takes the place of a conventional tree but allows for a comparatively large vertical through bore without any internal valves and at least large enough to accommodate the tubing completion.

While modern well technology may provide continuous access to the tubing annulus around the tubing string (the "A" annulus or production annulus), it has generally been accepted as being difficult, if not impossible, to provide continuous venting and/or monitoring of the pressure in the "B" annulus, the annulus around the outside of the innermost casing string. This has been because the B annulus must be securely sealed while the drilling BOP is removed from the wellhead, prior to installing the tree. In the case of a conventional style tree, installation of the tubing hanger in the wellhead, necessarily inside the production casing hanger, prevents access to the production casing hanger for the opening of a passageway from the production casing annulus.

Continuous access to the production casing annulus, or "B" annulus, allows monitoring of the fluid in the annulus over the life of the well for pressure and/or temperature. Pressure monitoring may be useful, for example, to determine if annulus pressure is approaching the burst pressure rating of the casing. Pressure monitoring might also be useful, for example, to determine if the B annulus pressure is approaching the collapse pressure rating of the production casing. Monitoring B annulus pressure would indicate when corrective action should be taken should the pressure approach these structural integrity extremes. Access, via porting, to the B annulus would enable corrective action to be performed.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
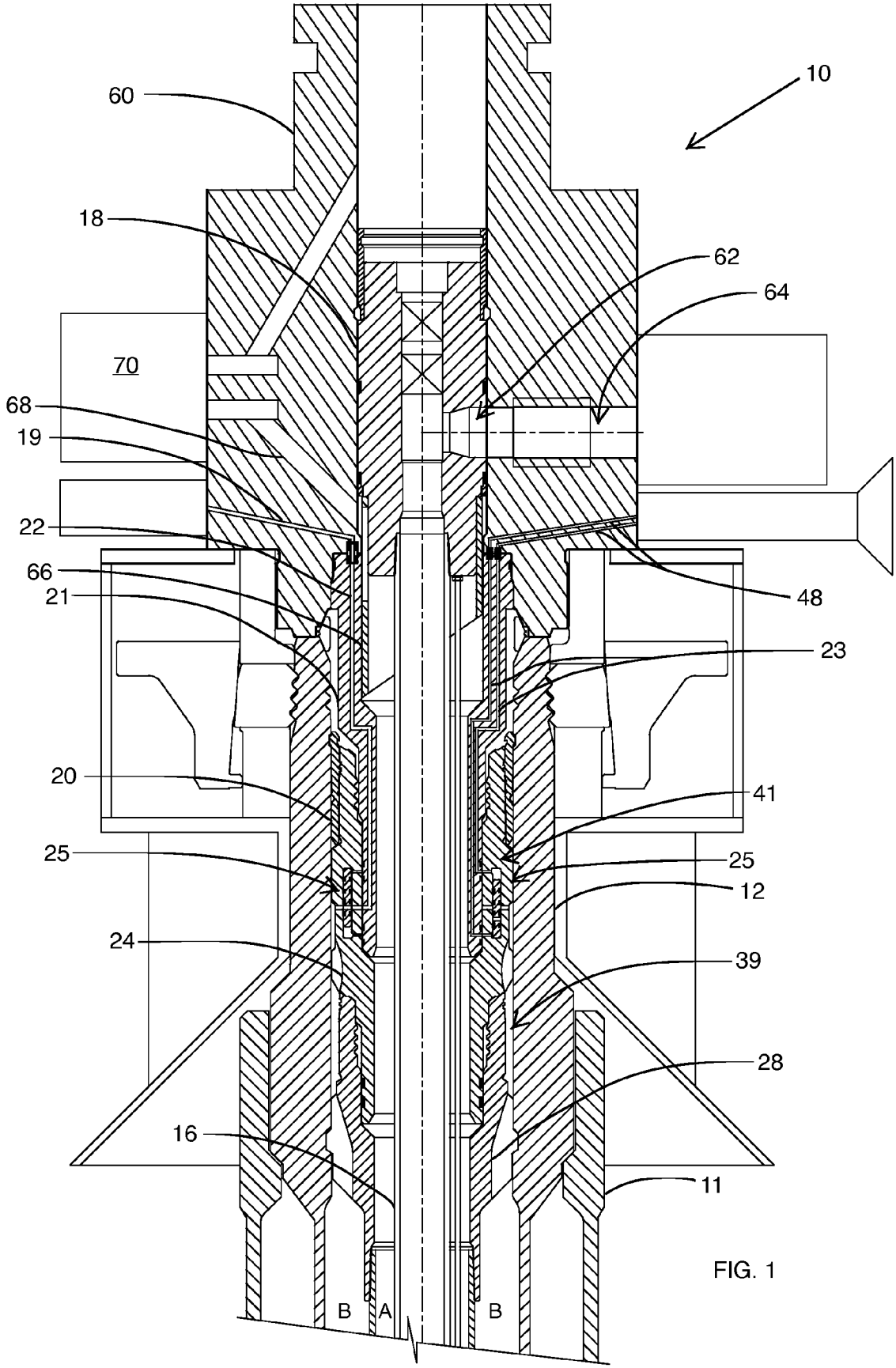
FIG. 1 is a cross-section view of an embodiment of a subsea completion including an annulus access adapter installed in a wellhead and also including a horizontal tree installed on the wellhead.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

An annulus access adapter with controlled annulus porting lands in a wellhead and incorporates a selector device that will open or close a path allowing casing hanger annulus access during well operations. The annulus selector can be operated, for example, using hydraulics supplied by a subsea tree or tubing spool. Hydraulics may be supplied by a remotely operated vehicle (ROV), subsea control module (SCM), or by hose or flying lead, from another source. The hydraulic connections may be temporary, such as during installation, workover, or recovery operations, or permanent. As an example, a production casing hanger may be landed in a subsea completion assembly. The subsea completion assembly also includes an annulus access adapter sealed at its lower end to the production casing that includes an annulus passage from the casing hanger annulus, the B annulus, to above the adapter. The adapter also includes a valve for selectively opening and closing the annulus passage during the life of the well.

Production casing annulus fluid monitoring can then be set up by monitoring the B annulus fluid using temperature, pressure, and/or flow sensor(s) in fluid communication with the B annulus though the passage in the annulus access adapter. The sensor(s) can then communicate the annulus fluid information to a platform via a control system. The tree may further include a valve to open and close the B annulus porting upstream and/or downstream from the sensor(s). The assembly may also include means for establishing fluid communication with the "A" annulus, the annulus between the production tubing and the production casing, from above the tubing hanger.

Figure 2:
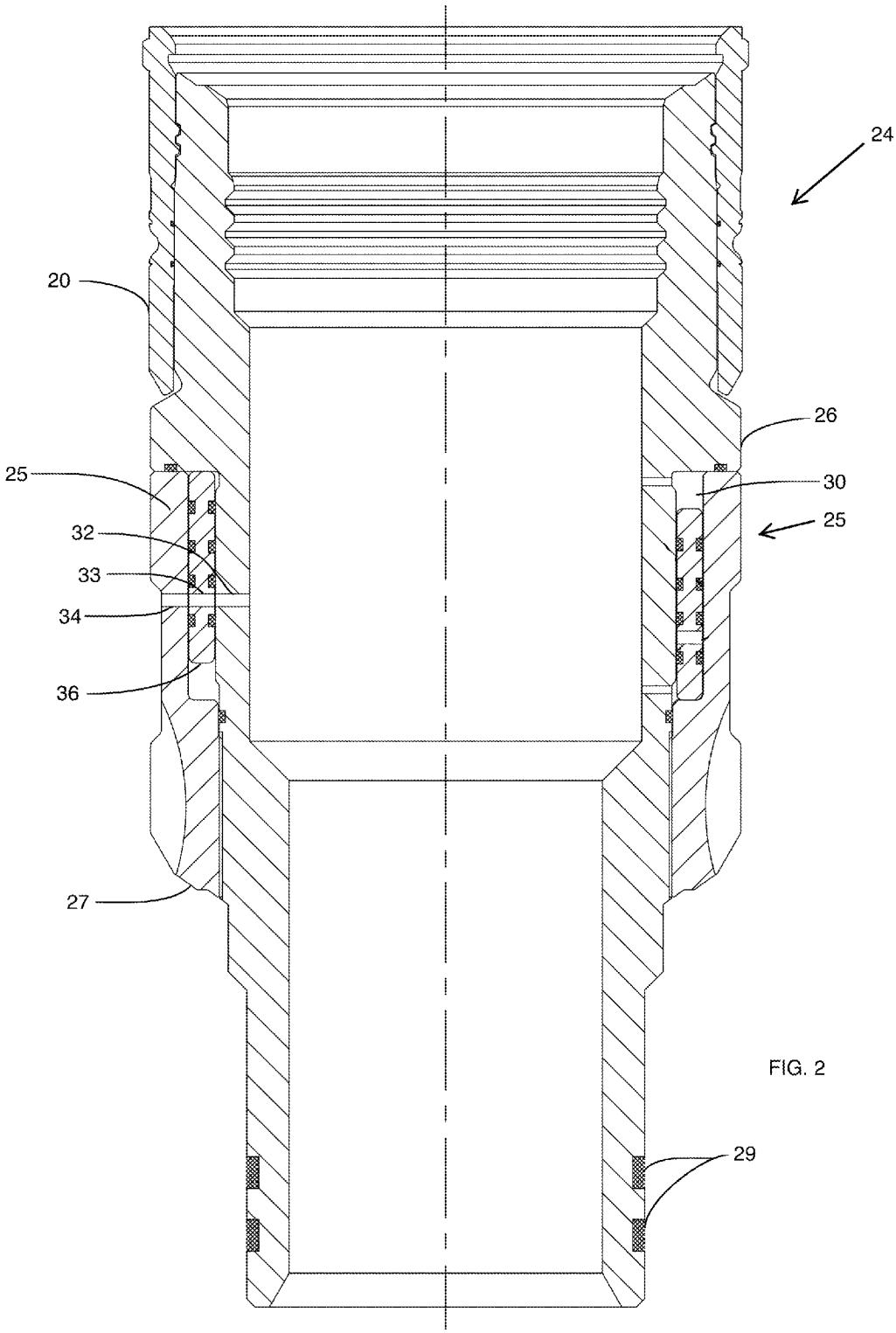
FIG. 2 is a cross-section view of the embodiment of FIG. 1 focusing on the annulus access adapter.
Figure 3:
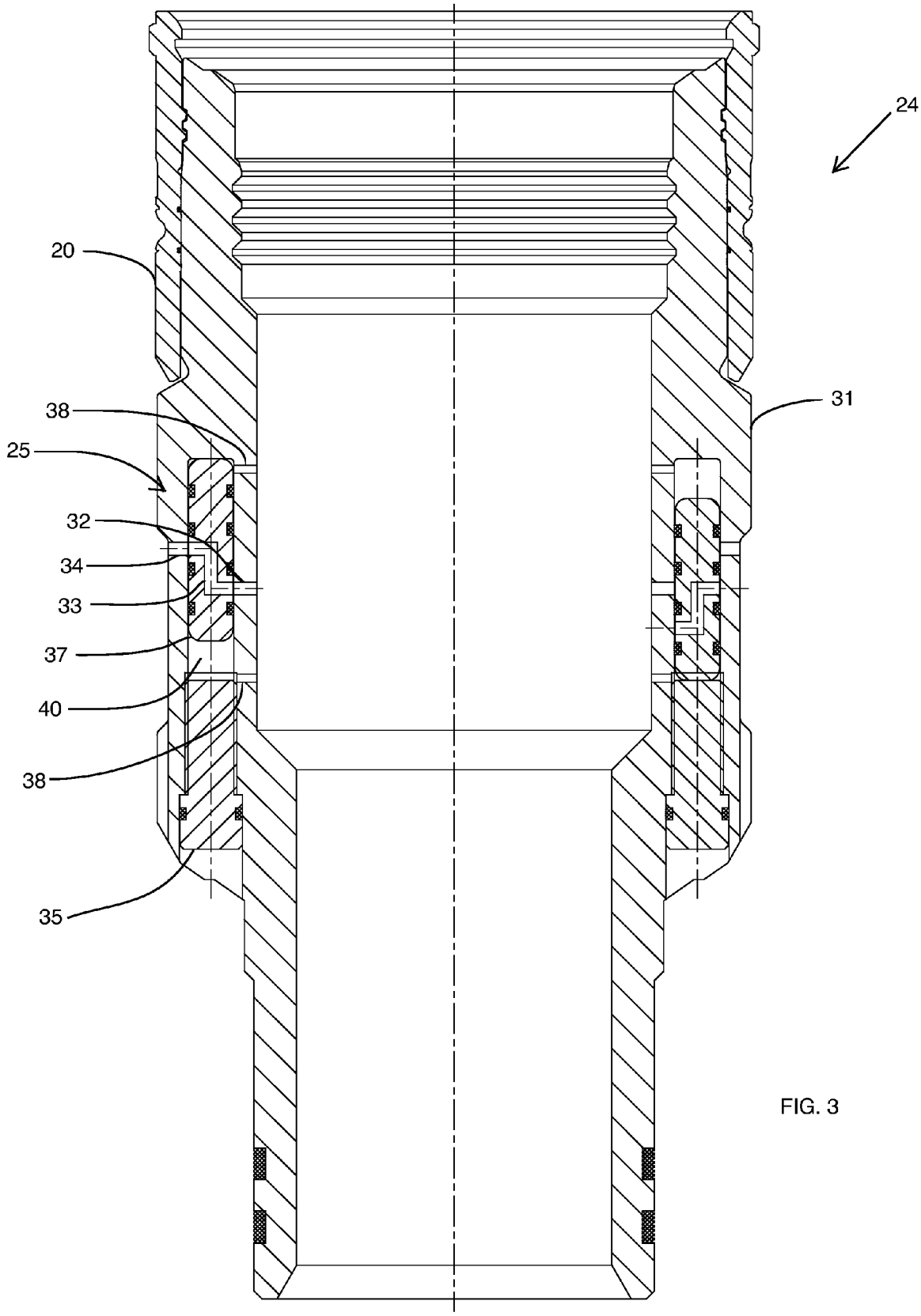
FIG. 3 is a cross-section view of the embodiment of FIG. 1 focusing on the annulus access adapter with an alternative adapter valve.

Referring initially to FIGS. 1, 2, and 3 there is shown an embodiment of a subsea completion assembly 10 that includes an annulus access adapter 24 in a horizontal tree completion configuration with a horizontal production tree 60. As shown, the subsea completion assembly 10 includes a conductor housing 11 with a high pressure housing 12 installed inside. The high pressure housing 12 supports a casing string extending into a wellbore. Another casing hanger 28, in this case the production casing hanger, is landed in the high pressure housing 12 and supports a casing string extending into the wellbore inside the high pressure housing casing. The annulus access adapter 24 lands in the subsea completion assembly 10 above the production casing hanger 28 and seals against the interior of the production casing hanger 28 using seals 29. A seal assembly 20 is installed above the adapter 24 to seal the top portion adapter 24 against the interior of the high pressure housing 12. The subsea completion assembly 10 also includes a tubing hanger 18 supporting a production tubing 16 extending into the borehole inside the production casing to define an "A" annulus. The tubing hanger 18 is landed in the production tree 60 and includes a horizontal production port 62 that is aligned with a tree horizontal production port 64 using any suitable alignment means, such as the alignment sleeve 66 shown.

The adapter 24 is in fluid communication with the fluid in the B annulus by way of an annulus 39 surrounding the production casing hanger 28. As shown, the annulus adapter 24 includes an adapter valve 25 that may be manipulated between positions to control fluid communication through the adapter 24. The adapter 24 is also in communication with the horizontal tree 60 installed above the high pressure housing 12 through the association of the adapter 24 and an isolation sleeve 21. The adapter 24 and the isolation sleeve 21 are engaged using annular, axially spaced seals configured as an annular seal system interface 41. To communicate fluid with the tree 60, the isolation sleeve 21 includes an annulus fluid port or ports 22 extending through the isolation sleeve 21 to the interface 41. The port(s) 22 is connected with an annulus fluid line 19 extending into the tree 60 using any suitable connection, such as the stab connection shown. The annular seal system interface 41 includes annular seals that isolate annular sections of the interface 41 between the adapter 24 and the isolation sleeve 21. By creating sectioned annuli, annulus B fluid may flow from the adapter 24 to the isolation sleeve annulus fluid port 22 without requiring ports to be arcuately aligned, thus allowing greater freedom in configuring the final make up of the subsea completion assembly 10 and increased tolerances in the final dimensioning of the components. The annular seal system interface 41 is one of numerous methods used to connect porting between two components. For example, as an alternative method, ports facing down in the isolation sleeve 21 could align with ports facing up in the annulus access adapter 24 and form direct communication through any suitable barrier such as a seal stab.

It should be appreciated that the adapter valve 25 may be any suitable valve that allows access control of fluid communication through the adapter 24. For example, as shown in the specific embodiment in FIG. 2, the adapter 24 is configured as a three piece arrangement including an adapter body 26, a retainer ring 27, and a sliding sleeve valve 36. The sliding sleeve 36 reciprocates in a cavity 30 formed by the engagement of the adapter body 26 and the retainer ring 27. The sliding sleeve valve 36 controls fluid flow between the B annulus and the production tree 60 by reciprocating in the cavity 30 to place an adapter body port 32, a sliding sleeve port 33, and a retainer ring port 34 into joint communication as shown on the left hand side or out of joint communication as shown on the right hand side. It should be appreciated that the adapter body 26, sliding sleeve 36, and retainer ring 27 together causing an annular sealing interface allows for more than one port arcuately spaced around the adapter 24 should it be desired.

Another example configuration of the adapter valve 25 is shown in FIG. 3. Unlike FIG. 2, the adapter 24 shown in FIG. 3 does not include a retainer ring and is therefore a single piece adapter body 31. The configuration of FIG. 3 also includes a reciprocating shuttle valve 37 housed in a hole 40 formed from outside the body 31. A plug 35 is then used to seal the hole 40 with the shuttle valve 37 inside. The shuttle valve 37 is likewise manipulatable in the hole 40 to place an adapter body port 32, a shuttle port 33, and a retainer ring port 34 into joint communication as shown on the left hand side or out of joint communication as shown on the right hand side. There may also be more than one shuttle valve 37 located in one or more holes in a single adapter body 31.

Control of the adapter valve 25 is provided, for example, by hydraulics from the production tree 60. An operator may thus manipulate the relative pressure on either side of the sliding sleeve valve 36 or shuttle valve 37 to cause the sliding sleeve valve 36 to move within the cavity 30 or the shuttle valve 37 to move within the hole 40. The interface between the sleeve valve 36 and the adapter body 26 and retainer ring 27 and the interface between the shuttle valve 37 and the adapter body 31 may include positional detents (not shown). The hydraulic fluid may be communicated through hydraulic control lines 48 extending from the tree 60 to hydraulic fluid ports 23 in the isolation sleeve 21. To communicate hydraulic fluid from the tree 60, the hydraulic fluid ports 23 extend from the engagement with the tree 60, through the isolation sleeve 21, and terminate at the annular seal system 41 interface. The hydraulic port interfaces are likewise annular and axially spaced to align longitudinally with the correct interface. By creating sectioned annuli allowing fluid flow, fluid may communicate between the isolation sleeve hydraulic ports 23 and the adapter 24 without requiring the ports to be arcuately aligned, thus allowing greater freedom in configuring the final make up of the subsea completion assembly 10 and increased tolerances in the final dimensioning of the components.

Note that although the annulus access adapter 24 does not manipulate system flow access for the A annulus, the subsea completion assembly 10 allows opportunity for conventional operational control as it pertains to A annulus flow. A annulus access is provided through a port in the alignment sleeve 66 that opens to an A annulus port 68 that extends through the tree 60. The A annulus port 68 may interact with a valve 70 that controls access through the production tree 60.

Installation includes, with a drilling riser in place, running and landing the production casing hanger 28 by means, for example, of a traditional casing hanger and seal assembly running tool (CHASART). A casing cementing procedure may then be performed in which cement is applied down through the center of the production casing. The cement will return upward around the outside of the production casing displacing any fluids in the B annulus. During this procedure a casing hanger seal assembly (not shown) is suspended by the CHASART above the hanger seal gland in order for the displaced fluid in the B annulus to flow upward around the casing hanger 28 and CHASART and up the drilling riser.

After the cementing operation is completed, the CHASART will lower the seal assembly into the hanger seal gland, thus sealing the casing hanger 28 to the wellhead housing 12. The CHASART can remain in the well or be removed after setting the seal. The casing hanger seal assembly will remain installed until the cement is cured to the required consistency. This protects the cement from being subject to fluid translation through the cement during the curing process with could cause channeling in the cement.

After the cement is cured, the casing hanger seal assembly is retrieved to open the B annulus. If the CHASART still remains, the CHASART will be retrieved, pulling the casing hanger seal assembly back with it. If the CHASART has already been retrieved, a seal assembly retrieval tool will be run down to retrieve the seal assembly. The B annulus is now accessible.

The annulus access adapter 24 is then run, landed, and locked down on top of the production casing hanger 28 by means of a running tool. When landed, the adapter 24 will establish a seal to the casing hanger 28 and also to the wellhead housing 12 bore, thus sealing off the B annulus once again. The annulus adapter 24 can thus be considered as a casing hanger extension containing a valve or valves that allow access to the annulus. The running tool will be used to test the adapter 24 for functionality and seal integrity. The running tool is then removed leaving the annulus access adapter 24 installed and tested.

The annulus access adapter 24 is manipulatable such that an annulus B fluid passage from casing hanger 28 up past the production tubing hanger 18 is open or closed. With the passage closed, the BOP is removed and the production tree 60 is installed onto the high pressure housing 12. The BOP is then reinstalled on the production tree 60. A tool may then be run down through the BOP and the tree 60 to run or retrieve a bore protector located in the adapter body 26/31 bore and open the annulus B fluid passage. The production tubing string may then be run down through the BOP and the tree 60 until the tubing hanger 18 lands in the tree 60.

The adapter valve 25 may be operated into the open position when the subsea completion assembly 10 is installed such that sensors in the tree 60 are in fluid communication with the fluid in the B annulus. This allows the subsea completion system 10 to be holistically tested and monitored thus providing data to the operator about the current state of functionality of the subsea system. Before the tree 60 is removed, the adapter valve 25 may be operated to the closed position so the B annulus is not open to the ocean when the tree 60 is removed.

Workover operations provide another example of how the utility of annulus access adapter 24 can be realized in the subsea completion system 10. In workover scenarios, maintenance and treatments of a well are performed in order to maintain or increase production. For example, the production tubing string 16 may be removed after the adapter valve 25 has been oriented to the closed position and the well has stopped production flow. After the production tubing string 16 is replaced, the adapter valve 25 may be moved back into the open position. Typically, a workover rig will be placed on location and the necessary tasks are performed to meet the needs of that particular workover operation. The annulus access adapter 24 can be retrieved, re-furbished, and re-run rather easily using the protection of the workover rig and riser. In comparison, if a valve was located in a high pressure housing 12 body or casing hanger 28 body it would be harder to replace as those bodies are typically cemented in place.

In addition to closing and opening, the access to the B annulus allows the fluid pressure and/or temperature to be monitored using sensors in the production tree 60. While the adapter valve 25 is open, the sensors may determine, for example, that the B annulus fluid pressure is approaching either the burst or collapse pressure ratings of the production casing. When such an event is detected, the tree 60 may be operated to relieve or increase the B annulus fluid pressure as needed, thus preventing compromising the structural integrity of the production casing and potentially incurring financial loss.

Figure 4:
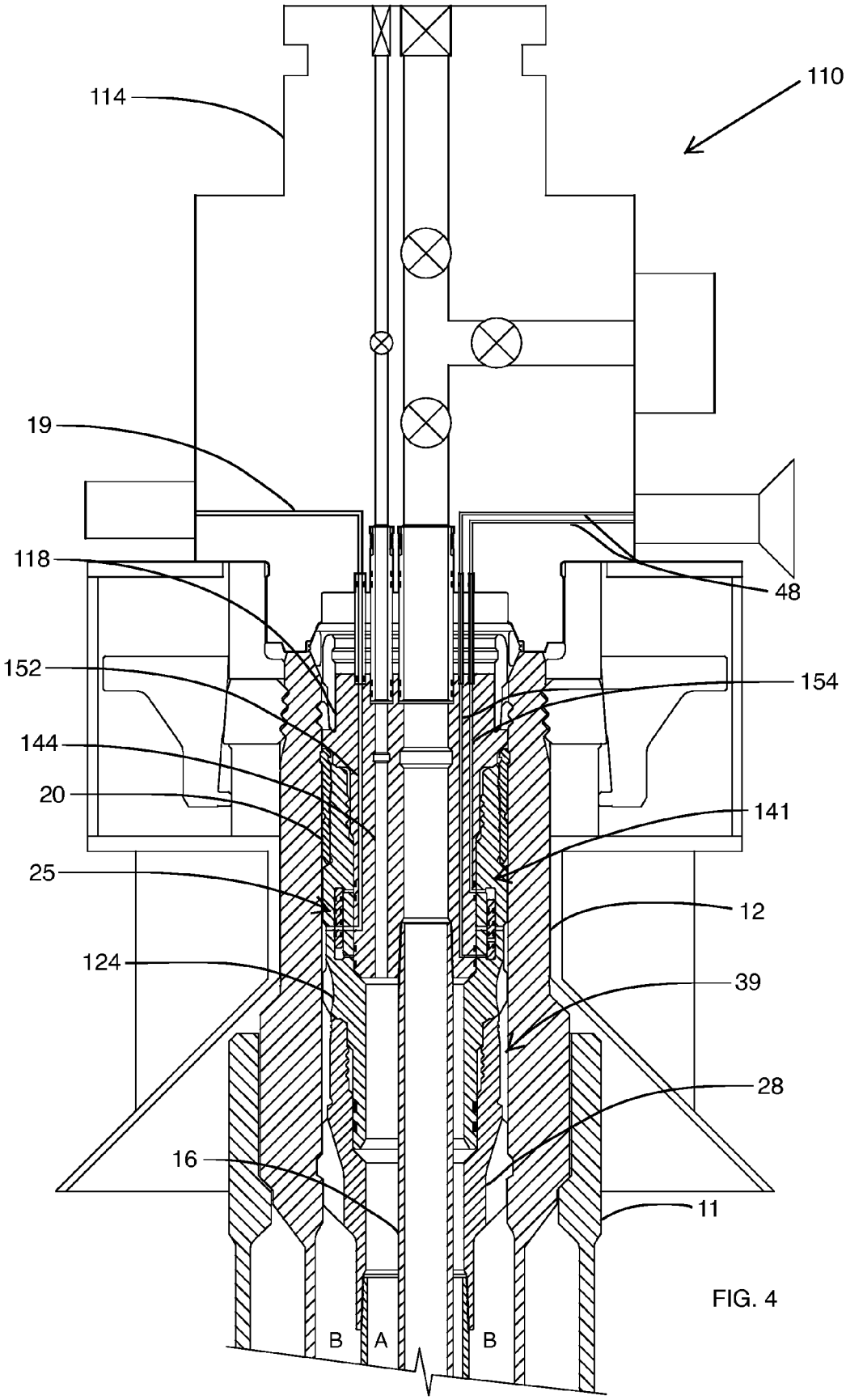
FIG. 4 is a cross-section view of another embodiment of a subsea completion including an annulus access adapter installed in a wellhead and also including a vertical tree installed on the wellhead with a tubing hanger installed in the annulus access adapter and configured as a dual bore completion.

Referring now to FIG. 4, there is shown another embodiment of a subsea completion assembly 110 with an annulus access adapter 124. As shown, the subsea completion assembly 110 includes a high pressure housing 12 installed inside a wellbore. The subsea completion assembly 110 is similar to the subsea completion assembly 10 with similar parts receiving similar reference designations. However, the subsea completion assembly 110 in FIG. 4 includes a vertical tree 114 and a dual bore completion tubing hanger 118 is landed in the annulus access adapter 24 itself within the high pressure housing 12. While operation of the access adapter 124 is similar, the assembly 110 does not include an isolation sleeve. Instead, the annular seal system interface 141 is used to communicate directly with an annulus fluid port 152 and hydraulic fluid ports 154 located in the tubing hanger 118 body and extending above the tubing hanger 118 into the production tree 114. The subsea completion assembly 110 thus uses the tubing hanger 118 to provide fluid communication between the production tree 114 and the fluid in the B annulus in similar operation to the assembly 10 discussed previously.

It is notable that although the annulus access adapter 124 does not manipulate system flow access for the A annulus, the assembly 110 allows opportunity for conventional operational control as it pertains to A annulus flow. A annulus access is provided by an A annulus bore 144 that extends through the tubing hanger 118 body. The annulus bore 144 may interact with wireline plugs or a valve (not shown) that control access through the production tree 114.

Figure 5:
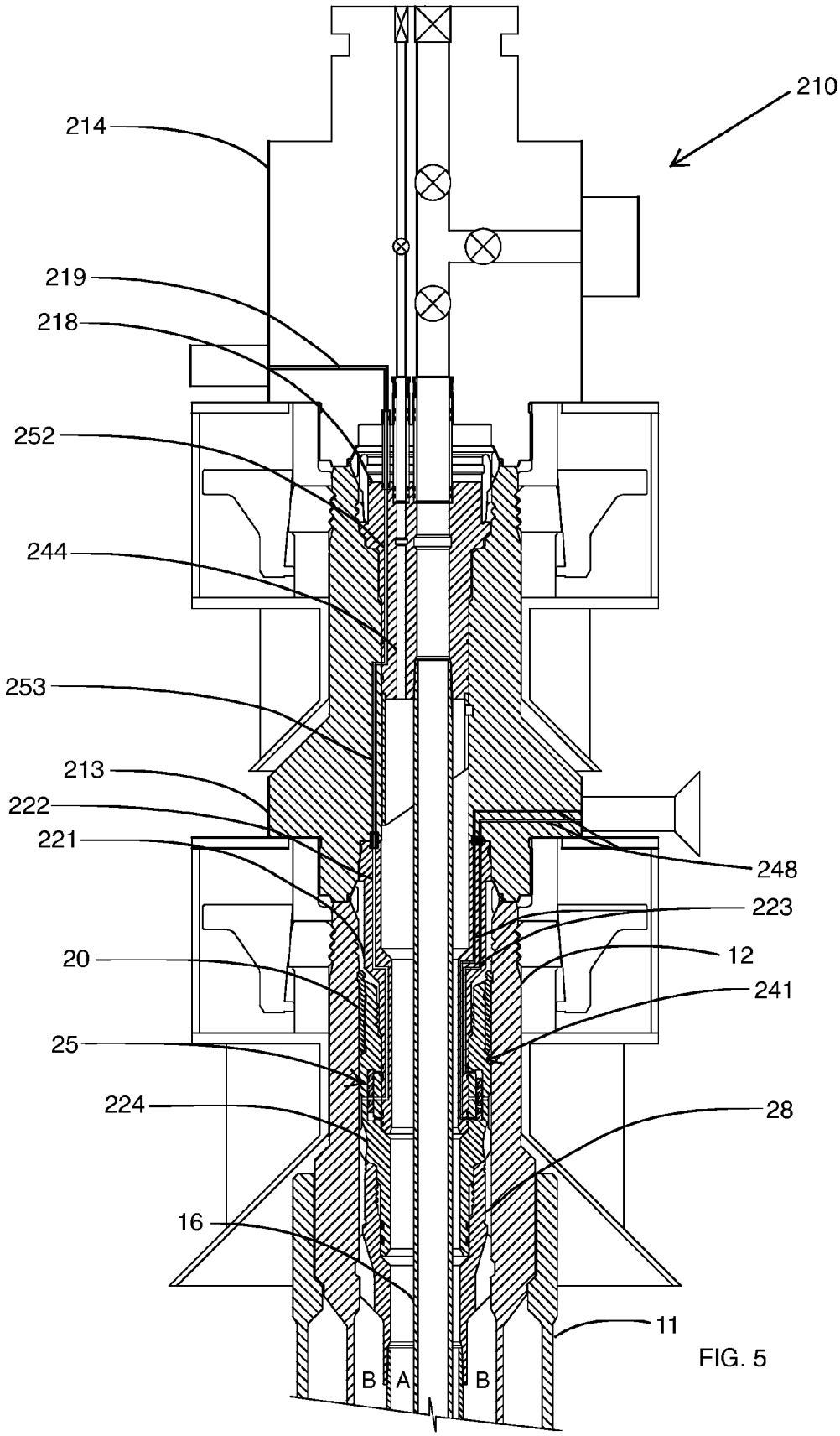
FIG. 5 is a cross-section view of another embodiment of a subsea completion including an annulus access adapter installed in a wellhead and also including a tubing spool with a vertical tree installed on the tubing spool and a tubing hanger installed in the tubing spool and configured as a dual bore completion.

Referring now to FIG. 5, there is shown another embodiment of a subsea completion assembly 210 with an annulus access adapter 224. As shown, the subsea completion assembly 210 includes a high pressure housing 12 installed inside a wellbore. The subsea completion assembly 210 is similar to the subsea completion assemblies 10 and 110 with similar parts receiving similar reference designations. However, the subsea completion assembly 210 in FIG. 5 includes a vertical tree 214 installed on a tubing spool 213. Also, a dual bore completion tubing hanger 218 is not landed in the high pressure housing 12 but is instead landed in the tubing spool 213. Also, instead of an isolation sleeve 21 extending from the production tree, the assembly 210 includes an isolation sleeve 221 extending from the tubing spool 213 to engage the adapter 224.

The adapter 224 is in fluid communication with the tubing spool 213 and the tree 214 through the association of the adapter 224 and the isolation sleeve 221 to form an annular seal system interface 241 in a similar manner as described above. To communicate fluid with the tubing spool 213, the isolation sleeve 221 includes an annulus fluid port or ports 222 extending from the interface 241 and communicating with an annulus fluid line 253 extending into the tubing spool 213 using any suitable connection, such as the stab connection shown. Annulus fluid line 253 also communicates with an annulus fluid line 252 extending into the tubing hanger 218. Annulus fluid line 252 communicates with an annulus fluid line 219 extending into the tree 214 using any suitable connection, such as the stab connection shown. Control of the adapter valve 25 may be provided, for example, by hydraulics from the tubing spool 213 communicated through hydraulic control lines 248 extending from the tubing spool 213 to hydraulic fluid ports 223 in the isolation sleeve 221. The hydraulic fluid ports 223 extend from the engagement with the tubing spool 213, through the isolation sleeve 221, and terminate at the interface 241. The subsea completion assembly 210 thus uses the tubing spool 213 to provide fluid communication between the production tree 214 and the fluid in the B annulus in similar operation to the assemblies 10 and 110 discussed previously. Fluid communication with the A annulus may be established using A annulus bore 244 in the tubing hanger 218 as previously described.

Figure 6:
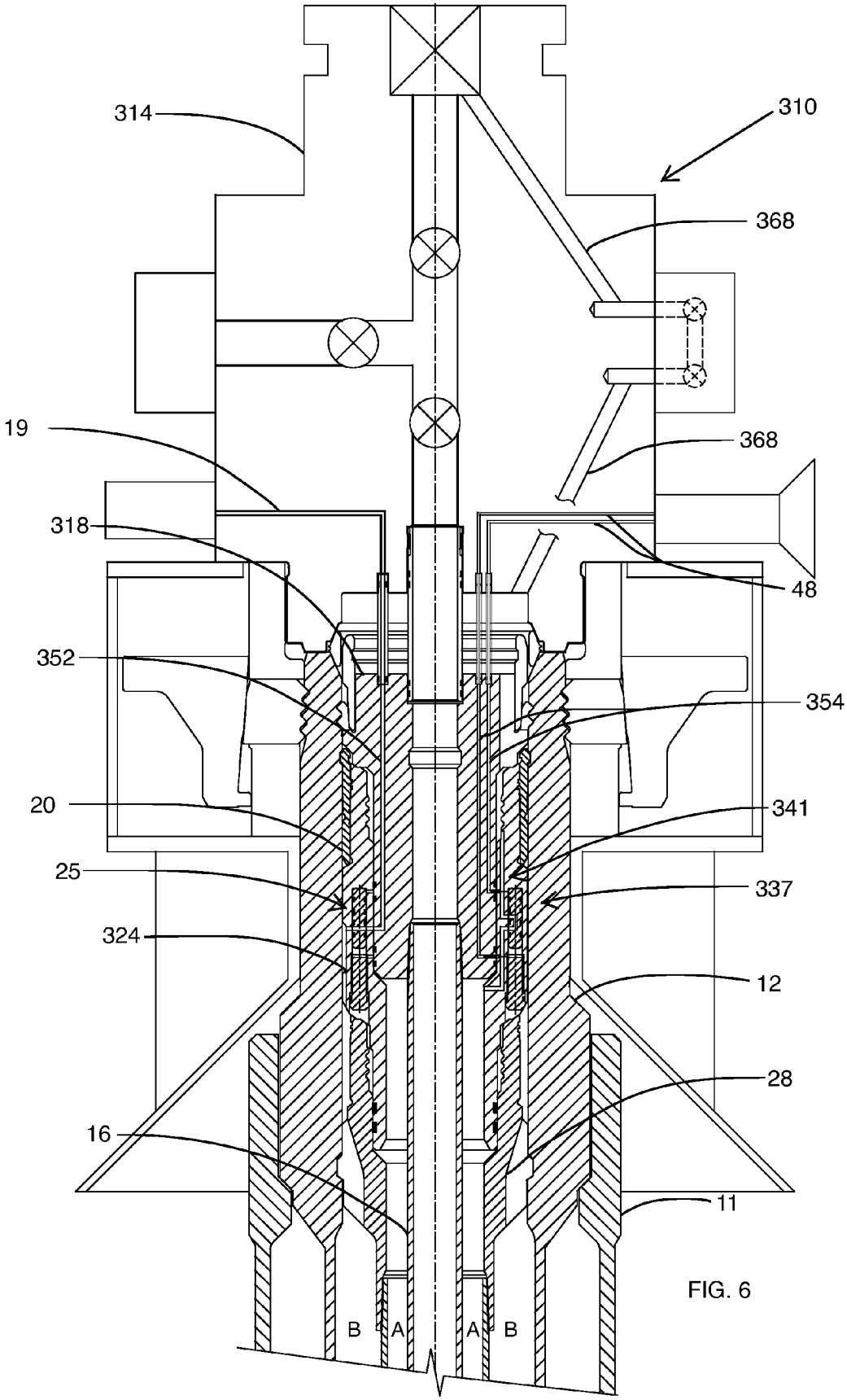
FIG. 6 is a cross-section view of another embodiment of a subsea completion including an annulus access adapter installed in a wellhead and also including a vertical tree installed on the wellhead with a tubing hanger installed in the annulus access adapter and configured as a monobore completion.

Referring now to FIG. 6, there is shown another embodiment of a subsea completion assembly 310 with an annulus access adapter 324. As shown, the subsea completion assembly 310 includes a high pressure housing 12 installed inside a wellbore. The subsea completion assembly 310 is similar to the subsea completion assembly embodiments previously described with similar parts receiving similar reference designations. However, the subsea completion assembly 310 in FIG. 6 includes a vertical tree 314 and a monobore completion tubing hanger 318 landed in the high pressure housing 12. While operation of the access adapter 324 is similar, the assembly 310 does not include an isolation sleeve. Instead, the annular seal system interface 341 is used to communicate directly with an annulus fluid port 352 and hydraulic fluid ports 354 located in the tubing hanger 318 body and extending above the tubing hanger 318 into the production tree 314. The subsea completion assembly 310 thus uses the tubing hanger 318 to provide fluid communication between the production tree 314 and the fluid in the B annulus in similar operation to the assembly embodiments discussed previously.

The assembly 310 allows opportunity for conventional operational control as it pertains to A annulus flow. A annulus access is provided by an A annulus adapter valve 337 located in the adapter 324. The A annulus adapter valve 337 operates in a similar manner as the adapter valve 25 and controls fluid communication from the A annulus on the interior of the adapter 324 below the tubing hanger 318 to the interior of the adapter 324 above the annular interface 341. Above the annular interface 341, A annulus fluid may communicate around the exterior of the tubing hanger 318 and with A annulus ports 368 in the tree 314.

Figure 7:
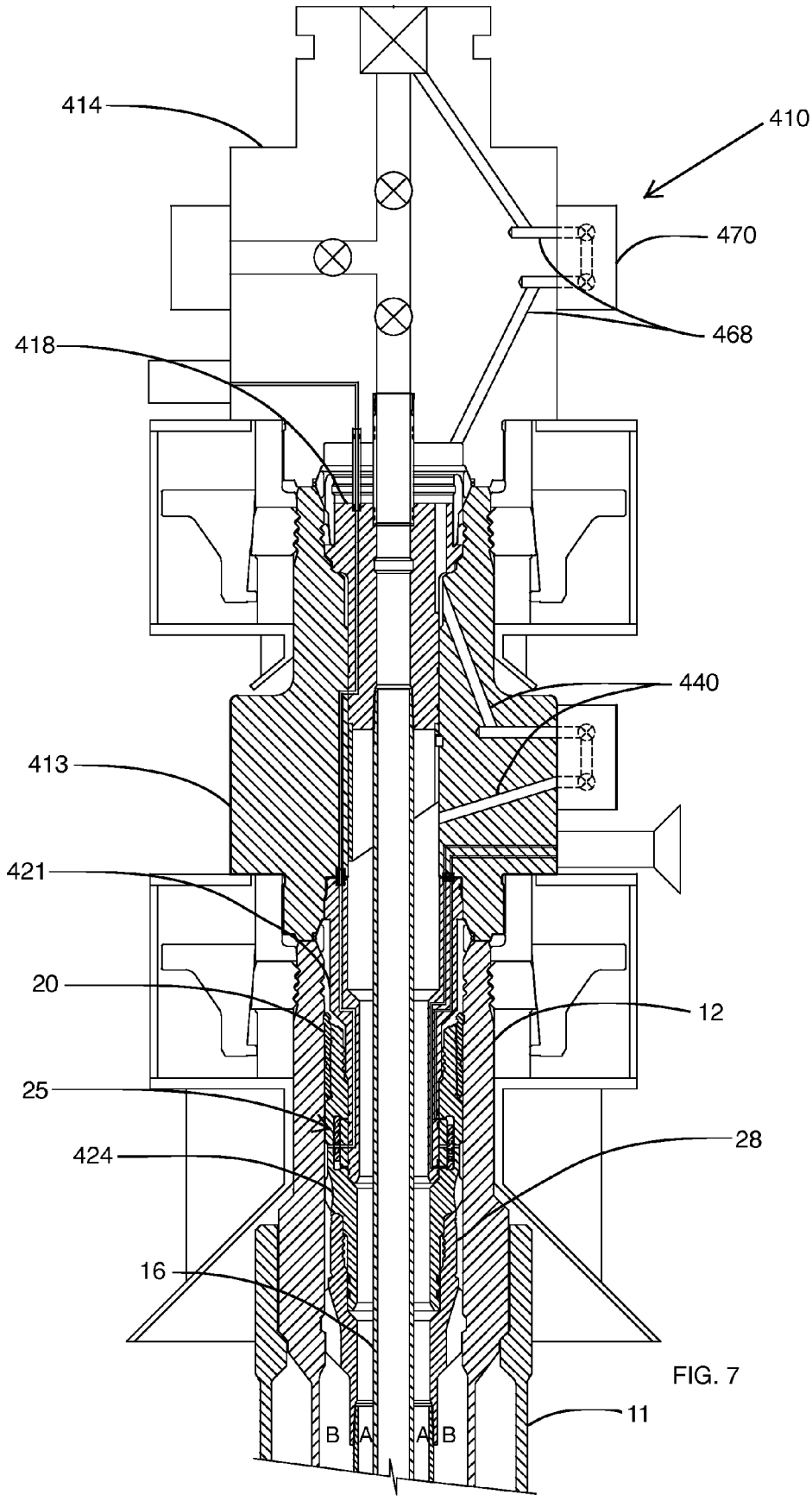
FIG. 7 is a cross-section view of another embodiment of a subsea completion including an annulus access adapter installed in a wellhead and also including a tubing spool with a vertical tree installed on the tubing spool with a tubing hanger installed in the tubing spool and configured as a monobore completion.

Referring now to FIG. 7, there is shown another embodiment of a subsea completion assembly 410 with an annulus access adapter 424. As shown, the subsea completion assembly 410 includes a high pressure housing 12 installed inside a wellbore. The subsea completion assembly 410 is similar to the subsea completion assembly embodiments discussed previously with similar parts receiving similar reference designations. The subsea completion assembly 410 in FIG. 7 includes a vertical tree 414 installed on a tubing spool 413 similar to the embodiment shown in FIG. 5. Also, a monobore completion tubing hanger 418 is landed in the tubing spool 413 and an isolation sleeve 421 extends from the tubing spool 413 to engage the adapter 424.

The subsea completion assembly 410 thus uses the tubing spool 413 to provide fluid communication between the production tree 414 and the fluid in the B annulus in similar operation to the assembly embodiments discussed previously. It is notable that although the annulus access adapter 424 does not manipulate system flow access for the A annulus, the assembly 410 allows opportunity for conventional operational control as it pertains to A annulus flow. A annulus access is provided by porting 440 located in the tubing spool 413 and porting 468 in the tree 414 and is controllable using a valve 470 in the tree 414.

Figure 8:
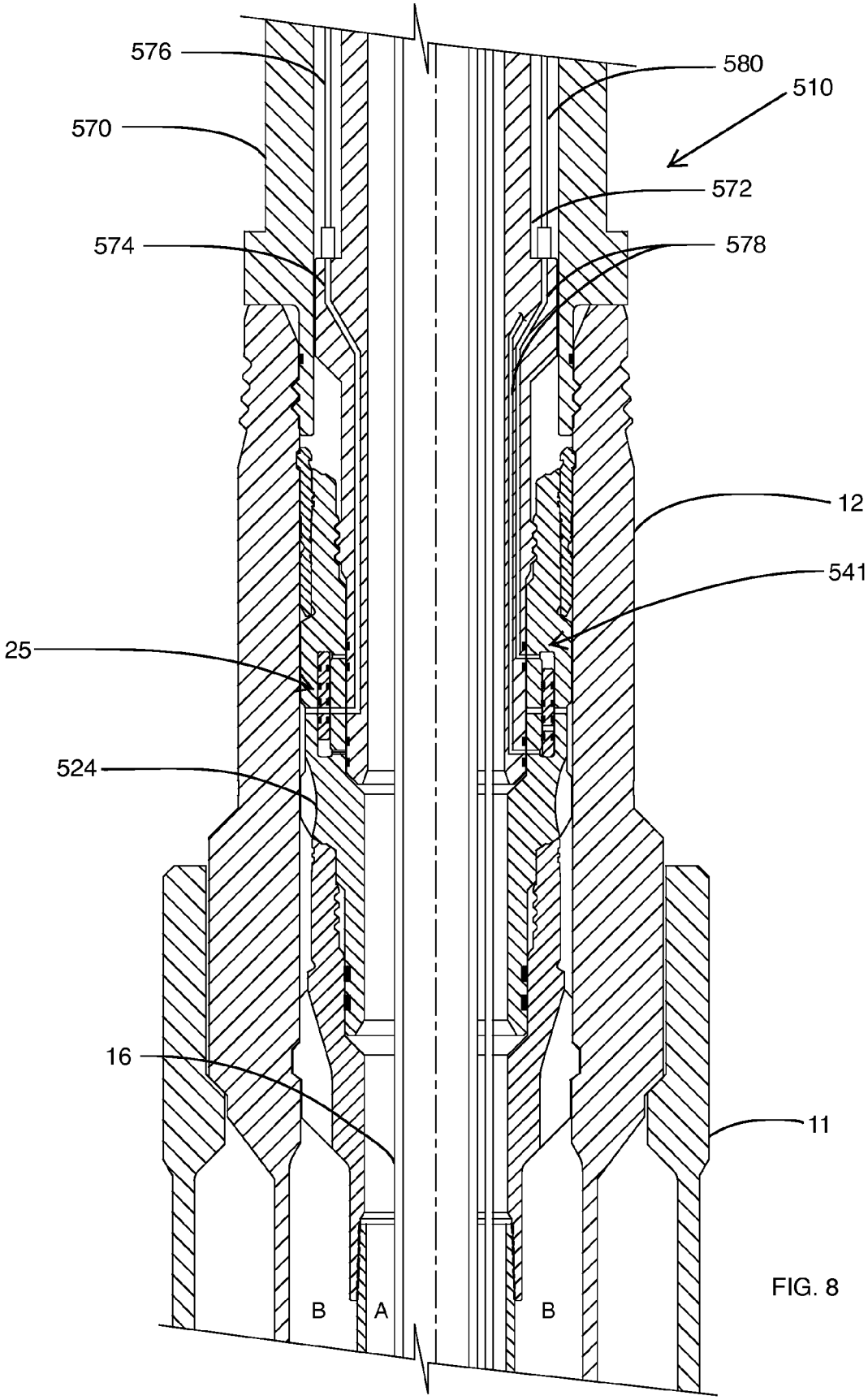
FIG. 8 is a cross-section view of another embodiment of a subsea completion including an annulus access adapter installed in a wellhead and also including a tieback tool.

Referring now to FIG. 8, there is shown another embodiment of a subsea completion assembly 510 with an annulus access adapter 524. As shown, the subsea completion assembly 510 includes a high pressure housing 12 installed inside a wellbore. The subsea completion assembly 510 is similar to the subsea completion assembly embodiments discussed previously with similar parts receiving similar reference designations. The subsea completion assembly 510 in FIG. 8, however, is configured as a tieback assembly with a completion riser 570 engaged with the housing 12 and a tieback tool 572 engaged with the adapter 524. An annulus fluid port 574 in the tieback tool 572 communicates B annulus fluid from the annular interface 541 to an annulus fluid line 576 that extends within the production riser 570 to the surface. Likewise, hydraulic control ports 578 in the tieback tool 572 communicate hydraulic fluid to the adapter 524 from hydraulic lines 580 that extend to the surface.

The subsea completion assembly 510 thus provides fluid communication with the fluid in the B annulus in similar operation to the assembly embodiments discussed previously. It is notable that although the annulus access adapter 524 does not manipulate system flow access for the A annulus, the assembly 510 allows opportunity for conventional operational control at the surface as it pertains to A annulus flow.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A subsea completion assembly for a subsea well including installed casing and a wellhead, the assembly including:

a production casing forming a B annulus between the outside of the production casing and the installed casing; and an annulus access adapter installed in the wellhead, the adapter including a valve controlling fluid communication with the fluid in the B annulus across the annulus access adapter;

the valve being selectively manipulatable between open and closed positions with the subsea completion assembly installed; and where a property of the fluid in the B annulus can be monitored by fluid communicated across the annulus access adapter.

2. The subsea completion assembly of claim 1, further including a subsea production tree including control equipment capable of manipulation of the annulus access adapter valve.

3. The subsea completion assembly of claim 1, where the annulus access adapter includes:

an adapter body;

a retainer ring secured to the outside of the adapter body so as to form an annular cavity between them; and the valve includes a sliding sleeve valve moveable within the cavity to control fluid communication across the annulus access adapter.

4. The subsea completion assembly of claim 1, where the annulus access adapter includes an adapter body and the valve includes a shuttle valve moveable within a hole formed in the adapter body.

5. The subsea completion assembly of claim 4, where the valve includes more than one shuttle valve moveable within more than one hole in the adapter body.

6. The subsea completion assembly of claim 1, further including:

a production tubing forming an A annulus between the outside of the production tubing and the inside of the production casing; and the annulus access adapter further including another manipulatable valve controlling fluid communication with the fluid in the A annulus across the annulus access adapter.

7. The subsea completion assembly of claim 1, further including an isolation sleeve landable in the annulus access adapter to form an annular seal interface, the isolation sleeve including:

annulus fluid ports that can communicate fluid in the B annulus from the adapter; and hydraulic fluid ports that can communicate hydraulic fluid to the annulus access adapter valve to operate the valve.

8. The subsea completion assembly of claim 1, further including a production tubing supported by a production tubing hanger, the production tubing hanger including annulus fluid ports that can communicate fluid in the B annulus from the adapter.

9. The subsea completion assembly of claim 1, further including a tieback tool landable in the annulus access adapter to form an annular seal interface, the tieback tool including:

annulus fluid ports that can communicate fluid in the B annulus from the adapter; and hydraulic fluid ports that can communicate hydraulic fluid to the annulus access adapter valve to operate the valve.

10. A subsea completion assembly for a subsea well including installed casing and a wellhead, the assembly including:

a production casing forming a B annulus between the outside of the production casing and the installed casing;

a production tubing forming an A annulus between the outside of the production tubing and the inside of the production casing; and an annulus access adapter installed in the wellhead, the adapter including a first manipulatable valve controlling fluid communication with the fluid in the B annulus across the annulus access adapter and a second manipulatable valve controlling fluid communication with the fluid in the A annulus across the annulus access adapter.

11. The subsea completion assembly of claim 10, further including a subsea production tree including control equipment capable of manipulation of the first and second annulus access adapter valves.

12. The subsea completion assembly of claim 10, where the annulus access adapter includes an adapter body and the first and second valves each include a shuttle valve moveable within a hole formed in the adapter body.

13. The subsea completion assembly of claim 12, further including more than one first and second valves.

14. The subsea completion assembly of claim 10, further including the production tubing supported by a production tubing hanger, the production tubing hanger including annulus fluid ports that can communicate fluid in the B annulus from the adapter.

15. A method of completing a subsea well including installed casing and a wellhead, the method including:

installing a production casing to form a B annulus between the outside of the production casing and the installed casing;

installing an annulus access adapter in the wellhead;

installing a production tubing to form an A annulus between the outside of the production tubing and the inside of the production casing; and selectively controlling fluid communication of fluid in the B annulus across the annulus access adapter with the production tubing installed.

16. The method of claim 15, further including:

installing a subsea tree; and controlling fluid communication of fluid in the B annulus using control equipment in the subsea tree.

17. The method of claim 15, further including:

the annulus access adapter including an adapter body and a retainer ring secured to the outside of the adapter body so as to form an annular cavity between them; and controlling fluid communication includes moving a sliding sleeve valve within the cavity to open and close the valve.

18. The method of claim 15, further including:

the annulus access adapter including an adapter body; and controlling fluid communication includes moving a shuttle valve within a hole formed in the adapter body.

19. The method of claim 18, where moving a shuttle valve includes moving more than one shuttle valve within more than one hole in the adapter body.

20. The method of claim 15, further including:

controlling fluid communication of fluid in the A annulus across the annulus access adapter.

21. The method of claim 15, further including:

landing an isolation sleeve in the annulus access adapter to form an annular seal interface;

communicating fluid in the B annulus from the adapter through the isolation sleeve; and where controlling fluid communication further includes communicating fluid through the isolation sleeve to a valve in the annulus access adapter to control the valve.

22. The method of claim 15, further including:

communicating fluid in the B annulus from the adapter through the production tubing hanger.

23. The method of claim 15, further including:

monitoring a property of the fluid in the B annulus communicated across the annulus access adapter; and adjusting a property of the fluid in the A annulus based on the value of the monitored property of the fluid in the B annulus.

24. A method of completing a subsea well including installed casing and a wellhead, the method including:

installing a production casing to form a B annulus between the outside of the production casing and the installed casing;

installing an annulus access adapter in the wellhead;

installing a tieback tool landable in the annulus access adapter to form an annular seal interface;

communicating fluid in the B annulus from the adapter through the tieback tool; \ selectively controlling fluid communication of fluid in the B annulus across the annulus access adapter; and where controlling fluid communication further includes communicating fluid through the tieback tool to a valve in the annulus access adapter to control the valve.

* * * * *